United States Patent [19]

Caplin et al.

[11] Patent Number: 4,644,450

[45] Date of Patent: Feb. 17, 1987

[54] LIGHTING UNIT FOR LIQUIDS

[75] Inventors: Roger W. G. Caplin, Bognor Regis; Roderic G. Southern; Gerald L. Fry, both of Waterlooville; David Hunt, Catherington, all of England

[73] Assignee: Novetta Limited, Waterlooville, England

[21] Appl. No.: 819,114

[22] Filed: Jan. 15, 1986

[30] Foreign Application Priority Data

Jan. 18, 1985 [GB] United Kingdom ..... 8501278

[51] Int. Cl.[4] ..... F21S 1/02

[52] U.S. Cl. ..... 362/147; 362/293; 362/294; 362/308

[58] Field of Search ..... 362/145, 147, 294, 293, 362/335, 308

[56] References Cited

U.S. PATENT DOCUMENTS

| | | | |
|---|---|---|---|
| 2,330,935 | 10/1943 | Tuck | 362/147 |
| 2,824,217 | 2/1958 | Karole | 362/294 |
| 4,433,366 | 2/1984 | Wade | 362/294 |
| 4,574,337 | 3/1986 | Poppenheimer | 362/294 |

*Primary Examiner*—Larry I. Schwartz

*Attorney, Agent, or Firm*—Beall Law Offices

[57] ABSTRACT

A lighting unit for liquids comprises a tubular member with a flange at one end and a screwthread at the other whereby it can be secured in the wall of a vessel to hold liquid. A holder engaged in the rear end of the tubular member holds a bulb such as an automobile head lamp bulb, and a lens is mounted in a recess in the front end of the tubular member. The lens has a convex front face, a concave rear face and a negative focal length and, with the light mounted close to the rear of the lens, gives a very wide angle of illumination. The angle may for example be 172° and the tubular member may be of only 7 cm diameter.

12 Claims, 2 Drawing Figures

LIGHTING UNIT FOR LIQUIDS

Figure 1:
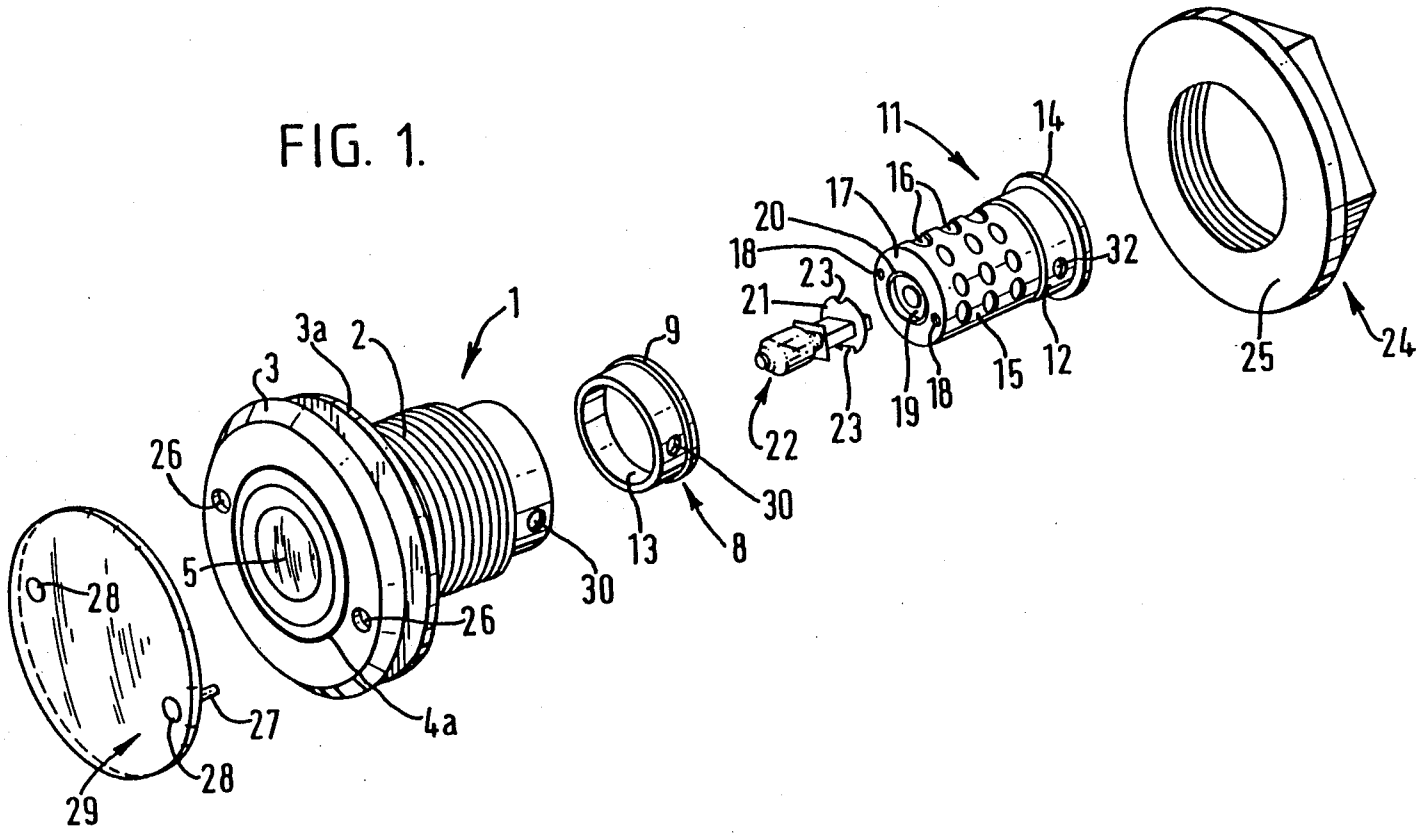

The invention relates to a lighting unit for liquids.

Lighting units for providing illumination below the surface of liquids in vessels is frequently required, for example in whirlpools, jaccuzzis, swimming pools, fountains, aquariums, vats used for industrial processes and other uses.

Previously proposed lighting units provided for this purpose have either provided only a narrow beam of light or have been unduly large in size, for example 10 cm to 17 cm diameter which has restricted their use to substantially planar walls since sealing such large diameter lighting units in curved walls presents almost insuperable problems. Previously proposed lighting units for this purpose have also had an unduly high power requirement, for example 100 to 300 watts at 12 volts, resulting in severe cooling problems.

According to the invention there is provided a lighting unit for liquids comprising a light source and mounting means for mounting the light source in a well of a vessel to contain liquid, in which said mounting means comprises a tubular member to be secured and sealed in a wall of a vessel to contain liquid, a mount for mounting a light source inserted into the rear end of the tubular member and means mounting a lens in the front end of the tubular member, the light source and the lens combining, when the front face of the lens is submersed in a liquid, to provide an angle of illumination of the liquid in excess of 100°.

The angle of illumination is advantageously in excess of 150° and preferably in excess of 170°.

The outside diameter of the tubular member is less than 12 cm in outside diameter, advantageously less than 9 cm in outside diameter and preferably less than 7 cm in outside diameter.

The light source is preferably a quartz halogen bulb of the kind used in automobile headlights and is preferably of 55 watts for use with a 12 volt supply but may be of other kind, for example of the fibre optic kind.

Where the bulb is a quartz halogen bulb means for mounting the bulb may comprise a perforated sleeve which extends within the tubular member from the rear end thereof and provides means for dissipating some of the heat generated by the bulb. If the lighting unit is to be used in a context where water will not necessarily always be provided in the vessel, heat sink means may be provided coupled to the tubular member to provide adequate heat dispersal in the absence of heat loss through the liquid.

Preferably the lens has a convex front face, a concave rear face and a negative focal length, that is to say the focal length of the lens is at a position to the rear of the front face of the lens, and the light source is located in very close proximity to the rear face of the lens.

In one embodiment of the invention the lens has an external diameter of 49.5 mm, a thickness ($T_1$) of 4.5 mm, the curved front face has a depth ($T_2$) of 2.5 mm, the front face curve is of plus 8.87 diopters, the rear face curve is of minus 33 diopters, the whole of the rear face of the lens is frosted and the lens is made of crown glass with a refractive index of 1.523.

Preferably the light source is so inserted in the rear end of the tube as to be relatively easily removable therefrom to replace or service the lighting source without breaking the seal of the tubular member in the wall of the vessel.

Colour filter members may be provided to be mountable over the front face of the lens to colour the light emanating from the lighting unit. Advantageously, two colours or more are provided on a filter with the interface between the two colours being provided as a generally horizontal line and preferably with the dark colour or a colour at the top and a light colour or white below.

If desired an electrical earthing clamp may be provided on the tubular member at the rear of the position in which the wall of the vessel is located in use.

The tubular member preferably has an outwardly extending flange adjacent its front end and a rearward portion of the tubular member has a screwthread on its outer diameter, a nut being provided to engage on the screwthreaded portion of the tubular member to pull the screwthreaded portion outwardly with respect to the wall of the vessel to press the flange against the inner face of the wall of the vessel with the interposition of a sealing gasket. A generally cylindrical recess is advantageously provided at the front end of the bore of the tubular member, which recess can receive the lens with the lens sealed in the recess by a flexible adhesive substance.

Preferably a peripheral groove is provided in the wall of the recess and a peripheral groove is provided in the outer edge of the lens, the grooves and receiving the flexible adhesive substance and securing the lens in the recess.

Bores may be provided in the front face of the flange of the tubular member, outwardly of the position at which the lens is located, to receive pegs extending from the colour filters and thereby secure the colour filters with respect to the tubular member.

Figure 2:
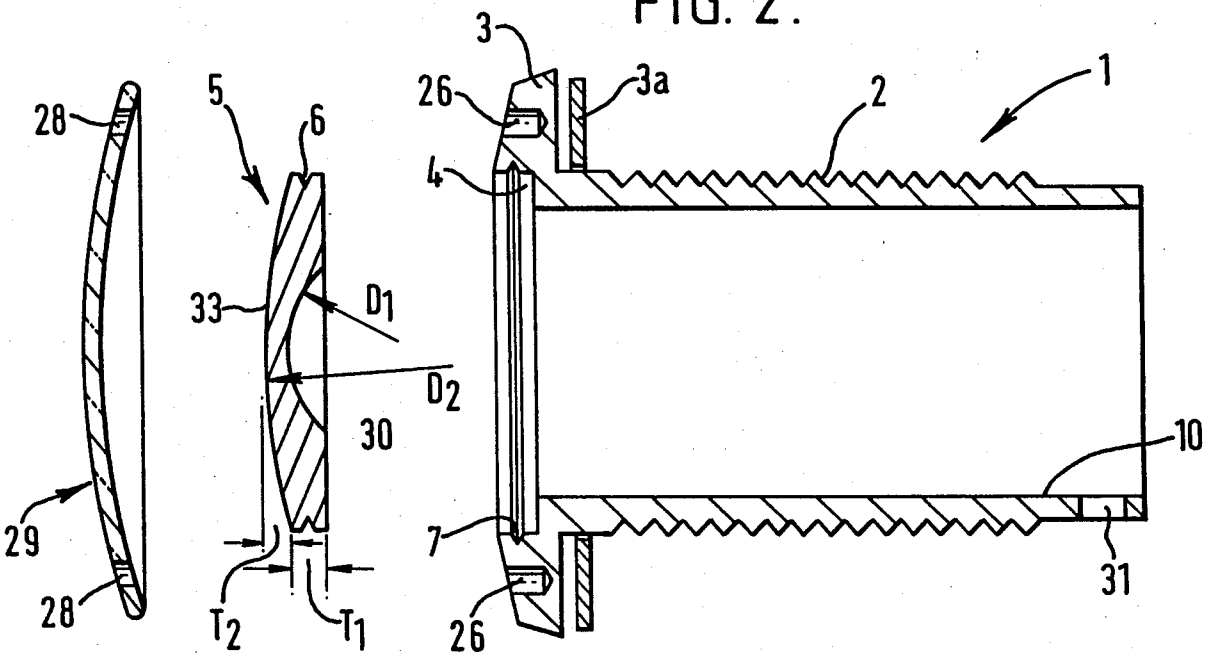

The invention is diagrammatically illustrated by way of example in the accompanying drawings, in which:

FIG. 1 is an exploded perspective view of a lighting unit according to the invention; and FIG. 2 is an exploded sectional elevation of a tubular member, lens and filter of the lighting unit of FIG. 1.

Referring to the drawings, a lighting unit comprises a tubular member 1 externally screwthreaded at 2 and having an outwardly extending flange 3 at its front end. The front face of the tubular member is recessed with a circular recess 4 to receive a lens 5, the lens 5 being potted into the recess 4 with a combined adhesive and sealant **4*a* which penetrates into a peripheral groove 6 in the outer edge of the lens 5 and into a peripheral groove 7 in the recess 4. After the sealant 4*a* has cured somewhat it remains flexible but loses the ability to be extruded and thus retains and seals the lens 5 in the recess 4**.

An annular collar 8 of electrically insulating material and having a shoulder 9 at its outer end is received as a sliding fit in the rear end of the bore 10 of the tubular member 1. A bulb mounting member 11 is generally cylindrical, has a portion 12 which is a sliding fit in the bore 13 of the collar 8, has a collar 14 at its outer end and has its inner end 15 of somewhat smaller diameter than the portion 12 and perforated by perforations 16. Preferably the bulb mounting member 11 is formed of aluminium alloy and at its front end is formed with a flange 17 with two screwthreaded apertures 18 therein and with a central bore 19 with a circular recess 20 in the forward face. The recess 20 receives a mounting plate 21 of a bulb 22, the mounting plate 21 having recesses 23 at opposite sides thereof to enable the mounting plate to be engaged in the recess 20 with the heads of screws engaged in the screwthreaded apertures 18 passing through the cut-outs 23. The mounting plate 21, together with the bulb 22, can subsequently be rotated about its longitudinal axis to engage portions of the plate 21 beneath the edges of the screw heads and thereby secure the bulb 22 on the bulb mounting member 11.

A nut 24 is provided to be engaged on the screwthread 2 of the tubular member 1, the nut 24 having a circular flange 25 at its forward face.

The flange 3 of the tubular member 1 includes two bores 26 to receive plastics peg members 27 which project through apertures 28 in a filter member 29, preferably formed of a flexible plastics material.

In use the threaded portion 2 of the tubular member 1 is engaged in an aperture in the wall of a vessel which is to contain liquid, the portion 2 being engaged in the aperture from the inside of the vessel, with a gasket 3*a* being provided between the flange 3 and the wall of the vessel. The nut 24 is engaged on the screwthreads 2 and rotated so that the flange 25 engages the outer face of the wall of the vessel to clamp the tubular member 1 in the wall of the vessel and effect sealing by the gasket 3*a*. The lens 5 will already have been plotted into the front end of the tubular member 1 in the recess 4.

The bulb 22 is mounted on the bulb mounting member 11, the collar 8 is engaged in the rear end of the tubular member 1 and the bulb mounting member is inserted into the collar 8 and pressed fully forward thereby to position the bulb 22 closely adjacent the rear face of the lens 5 and indeed to engage it within a recess having a curvature D1 in the rear face of the lens 5. A screw (not shown) of electrically insulating material is then inserted through aligned radially extending apertures 30 in the tubular member 1 and the collar 8 and engaged in an aperture 32 in the bulb mounting member 11, which aperture 32 is screwthreaded. The screw secures the bulb mounting member 11 and collar 8 in position with respect to the tubular member 1. Wires extend from the the bulb 22 outwardly through the rear of the tubular member 1, the bulb 22 being a 55 watt quartz halogen automobile bulb designed to operate on a 12 volt supply.

If colouration is desired of the light emerging from the front face 33 of the lens 5, one of the filter members 29 of suitable colour an be engaged on the front end of the tubular member 1 by engaging the peg like members 27 in the bores 26.

The maximum diameter of the flange 3 is preferably 75 mm, the diameter of the screwthreaded portion 2 is preferably 50 mm and the distance from the rear face of the flange 3 to the free end of the tubular member 1 is preferably approximately 75 mm. Due to the very small diameter of the tubular member 1, compared with previously proposed lighting units, it is possible to mount the lighting unit in vessels having curved walls without causing undue sealing problems.

The lens 5 preferably has an external diameter D2 of 49.5 mm a thickness $T_1$ of 4.5 mm, the curved front face 33 has a depth $T_2$ of 2.5 mm, the front face curve 33 being of plus 8.87 diopters, the rear curve being of minus 33 diopters and the whole of the rear face of the lens being frosted. The lens can be made of crown glass with a refractive index of 1.523 with the curvatures given above. Alternatively, with suitable changes in curvature which will be apparent to a man skilled in the art it could be made of flint glass, for example the material Hilite sold by Corning Glass Co of the United States of America with a refractive index of 1.79 or the glass FX1 sold by Pilkington Glass Company Limited. The lens specified above can, when submerged in water, provide illumination over a cone of 172° angle.

The bulb mounting member 11 with the perforation 16 therein provides some heat dissipation for the heat generated by the bulb 22 but the major part of such heat is required to be dissipated through the lens 5 and the flange 3 into the liquid.

One considerable advantage of the lighting unit of the invention is that if the bulb 22 should fail it can be replaced without draining the liquid from the vessel and since the bulb mounting member can be simply withdrawn from the rear end of a tubular member 1, the bulb can be replaced by a relatively unskilled person.

What is claimed is:

1. A lighting unit for liquids to be secured and sealed in a wall of a vessel to contain liquid, comprising:

a tubular member having a front end, a rearward portion, an outwardly extending flange adjacent said front end, and a screw thread on the outer diameter of said rearward portion;

a nut threadable on the screw thread of the rearward portion of said tubular member during assembly to pull the screw threaded portion outwardly with respect to the wall of the vessel to press said flange against the inner face of the wall of the vessel with the interposition of a sealing gasket for sealing the interior of the front end of the tubular member;

means for mounting a light source into the rear end of said tubular member;

means for mounting a lens in the front end of said tubular member in front of said light source;

means sealing the interior of the front end of the tubular member;

means including said light source and said lens, when the front of said lens is submersed in a liquid of the vessel, to provide an angle of illumination of the liquid in excess of 100 degrees; and means for withdrawal of said light source from the rearward portion of said tubular member to change the bulb with said lens being mounted, said nut being assembled, the front face of the lens being submersed and the front end of the tubular member being sealed.

2. A lighting unit as claimed in claim 1, in which the angle of illumination is in excess of 150°.

3. A lighting unit as claimed in claim 1, in which the angle of illumination is in excess of 170°.

4. A lighting unit as claimed in claim 1, in which the outside diameter of said tubular member is less than 7 cm.

5. A lighting unit as claimed in claim 1, in which said light source is a quartz halogen bulb of the kind used in automobile headlights and is of 55 watts for use with a 12 volt supply.

6. A lighting unit as claimed in claim 5, in which the means for mounting said bulb comprises a perforated sleeve which extends within said tubular member from the rear end thereof and provides means for dissipating some of the heat generated by said bulb.

7. A lighting unit as claimed in claim 1, in which said lens has a convex front face, a concave rear face and a negative focal length and said light source is located in very close proximity to said rear face of said lens.

8. A lighting unit as claimed in claim 7, in which said lens has an external diameter of 49.5 mm, a thickness of 4.5 mm, said curved front face has a depth of 2.5 mm, the front face curve is of plus 8.87 diopters, the rear face curve is of minus 33 diopters, the whole of the rear face of said lens is frosted and said lens is made of crown glass with a refractive index of 1.523.

9. A lighting unit as claimed in claim 1, in which said tubular member has an outwardly extending flange adjacent its front end and a rearward portion of said tubular member has a screwthread on its outer diameter, a nut being provided to engage on the screwthreaded portion of said tubular member to pull the screwthreaded portion outwardly with respect to the wall of the vessel to press said flange against the inner face of the wall of the vessel with the interposition of a sealing gasket.

10. A lighting unit as claimed in claim 9, in which bores are provided in the front face of said flange of said tubular member, outwardly of the position at which said lens is located, to receive pegs extending from a colour filter and thereby secure the colour filter with respect to said tubular member.

11. A lighting unit as claimed in claim 1, in which a generally cylindrical recess is provided at the front end of the bore of said tubular member, which recess can receive said lens with said lens sealed in said recess by a flexible adhesive substance.

12. A lighting unit as claimed in claim 11, in which a peripheral groove is provided in the wall of said recess and a peripheral groove is provided in the outer edge of said lens, the grooves receiving the flexible adhesive substance and securing said lens in said recess.

* * * * *